US011549685B2

(12) United States Patent
Muste-Herrera et al.

(10) Patent No.: US 11,549,685 B2
(45) Date of Patent: Jan. 10, 2023

(54) FLAME PRODUCING ASSEMBLY AND METHOD FOR MANUFACTURING SUCH A FLAME PRODUCING ASSEMBLY

(71) Applicant: SOCIETE BIC, Clichy (FR)

(72) Inventors: Jordi Muste-Herrera, Tarragona (ES); Josep Altes-Sabate, Tarragona (ES); Eloi Gonzalvo-Tarrago, Tarragona (ES)

(73) Assignee: SOCIETE BIC, Clichy (FR)

( * ) Notice: Subject to any disclaimer, the term of this patent is extended or adjusted under 35 U.S.C. 154(b) by 620 days.

(21) Appl. No.: 16/468,339

(22) PCT Filed: Dec. 13, 2016

(86) PCT No.: PCT/EP2016/080851
§ 371 (c)(1),
(2) Date: Jun. 11, 2019

(87) PCT Pub. No.: WO2018/108254
PCT Pub. Date: Jun. 21, 2018

(65) Prior Publication Data

US 2020/0292171 A1 Sep. 17, 2020

(51) Int. Cl.

| | |
|---|---|
| ***F23Q 2/40*** | (2006.01) |
| ***F23Q 2/28*** | (2006.01) |
| ***F23Q 2/16*** | (2006.01) |
| *F23Q 2/173* | (2006.01) |
| *F23Q 2/42* | (2006.01) |

(52) U.S. Cl.
CPC ..... *F23Q 2/287* (2013.01); *F23Q 2/164* (2013.01); *F23Q 2/163* (2013.01); *F23Q 2/173* (2013.01); *F23Q 2/40* (2013.01); *F23Q 2/42* (2013.01)

(58) Field of Classification Search
CPC ..... F23Q 2/287; F23Q 2/164; F23Q 2/163; F23Q 2/173; F23Q 2/40; F23Q 2/42
USPC ..... 431/153; 251/902
See application file for complete search history.

(56) References Cited

U.S. PATENT DOCUMENTS 2,638,925 A * 5/1953 Monohan ..... 137/655
4,424,018 A * 1/1984 Lowther, Sr. ..... F23D 3/16 431/288
4,778,380 A 10/1988 Nitta
5,865,614 A 2/1999 Hsu
(Continued)

FOREIGN PATENT DOCUMENTS

WO WO 01/63179 A1 * 8/2001 ..... F23Q 2/16

OTHER PUBLICATIONS

International Search Report of International Application No. PCT/EP2016/080851; dated Sep. 21, 2017.

*Primary Examiner* — Alfred Basichas
(74) *Attorney, Agent, or Firm* — Polsinelli PC

(57) ABSTRACT

A flame producing assembly including a pocket lighter and a sub-unit assembly. The sub-unit assembly includes an extended wand, a rigid support and a helical spring. The pocket lighter is connected to the sub-unit assembly. The pocket lighter includes a piezoelectric ignition device. The rigid support is located inside the extended wand and includes a longitudinal inner opening. The extended wand is electrically coupled to the piezoelectric ignition device, wherein the pocket lighter is connected directly to the sub-unit assembly and wherein the helical spring extends along the longitudinal inner opening.

20 Claims, 9 Drawing Sheets

(56) References Cited

U.S. PATENT DOCUMENTS

| | | | | |
|---|---|---|---|---|
| 5,980,242 | A | 11/1999 | Man | |
| 2005/0053881 | A1 | 3/2005 | Sgroi et al. | |
| 2006/0281039 | A1* | 12/2006 | Luo | F23Q 2/287<br>431/255 |
| 2015/0300511 | A1* | 10/2015 | Fima | F16K 15/148<br>137/512 |
| 2016/0242390 | A1* | 8/2016 | Lynch | A01K 15/025 |

* cited by examiner

FLAME PRODUCING ASSEMBLY AND METHOD FOR MANUFACTURING SUCH A FLAME PRODUCING ASSEMBLY

CROSS REFERENCE TO RELATED APPLICATION(S)

This application is a National Stage Entry Application of WO2018/108254, filed Dec. 13, 2016, the entire content of which is incorporated herein by reference.

FIELD

The present disclosure relates to a flame producing assembly and more particularly a utility lighter in which the flame is directed downwards. Such a flame producing assembly can be used for example to ignite candles, barbecue grills, fireplaces or campfires. Another aspect of the disclosure involves a method for manufacturing such a flame producing assembly.

BACKGROUND

In order to light candles, a utility lighter is directed downwards, contrary to a light for lighting a cigarette for instance, in which the flame is directed upwards. So, to ignite a candle (or other device such as for example, a barbecue grill) while keeping the fingers and especially the thumb of the user away from the flame, the utility lighter must have a flame that is directed away from the activation button.

It is already known to use utility lighters provided with an extended wand at the end of where the flame emanates. These types of utility lighters typically have several components located inside the extended wand in order to ignite the flame, which leads to a complexity of the assembly during the manufacturing. Therefore, there is a need to provide a utility lighter which is easier to manufacture.

SUMMARY

According to the present disclosure, a flame producing assembly is designed in such a way that it is easy to manufacture and that the flame is ignited away from the finger to a user. To this end, the flame producing assembly according to the disclosure includes a pocket lighter and a sub-unit assembly comprising an extended wand, a rigid support and an helical spring, the pocket lighter being connected to the sub-unit assembly, the pocket lighter includes a piezoelectric ignition device, the rigid support being located inside the extended wand, the rigid support having an longitudinal inner opening, the extended wand being electrically coupled to the piezoelectric ignition device, the pocket lighter being connected directly to the sub-unit assembly, and the helical spring extending along the longitudinal inner opening. Such a configuration of the components of the flame producing assembly has the advantage to be easily assembled to each other.

In various embodiments, one and/or the other of the following features may be incorporated in the flame producing assembly, alone or in mutual combination:

- the helical spring extends along the entire length of the longitudinal inner opening, which has the advantage to facilitate the fabrication of a utility lighter;
- the helical spring has a gas duct function, allowing a reduction in the number of elements required to provide a utility lighter;

- the pocket lighter comprises a reservoir and the helical spring is in fluid communication with the reservoir, the gas being released from the reservoir can thus pass through the helical spring;
- the helical spring comprises a material having electrical properties allowing the conveyance of the electric charge produced by the piezoelectric ignition device, the helical spring having therefore an electrical conduction function. Such a feature allows preventing the use of any electrical wiring;
- the helical spring is electrically coupled to the piezoelectric ignition device, which allows the helical spring to be an electrical conductor;
- the rigid support comprises a protrusion and the extended wand comprises a recess, the recess being adapted to cooperate with the protrusion, such a cooperation allowing a good holding of the rigid support inside the extended wand;
- the helical spring has a length comprised between 5 mm and 120 mm and an outer diameter comprised between 0.5 mm and 2 mm, the helical is therefore long enough to pass through the rigid support;
- the helical spring comprises a first end portion and a second end portion, the second end portion being a diffuser, an additional diffuser being thus not necessary;
- the rigid support extends along a longitudinal axis between a connecting end and a free end, wherein the extended wand extends along the longitudinal axis between a connecting end and a free end, wherein the helical spring has a first end portion and a second end portion, the second end portion being a diffuser protruding among the free end of the rigid support toward the free end of the extended wand along the longitudinal axis, such an arrangement providing a favorable space to ignite the flammable gas;
- the helical spring has a pitch comprised between 0.1 mm and 0.6 mm;
- the first end portion of the helical spring has a pitch comprised between 0.2 mm and 0.6 mm, the first end portion is thus well dimensioned to fulfill sufficient deformation for a proper electrical contact with the top of jet;
- the second end portion of the helical spring has a pitch comprised between 0.2 mm and 0.6 mm, the second end portion is thus well dimensioned to fulfill a diffuser feature;
- at least a portion of the helical spring being located in the longitudinal inner opening has a pitch smaller than the pitch of the top portion, to an extend that it facilitates the insertion of the helical spring in the rigid support;
- the sub-unit assembly is rigid, which make it easier the assembly the snap-fit assembly between the sub-unit assembly and the pocket lighter;
- the sub-unit assembly is snap-fitted to the pocket lighter, thereby allowing a large-scale production.

Another object of the present disclosure is a method for manufacturing a flame producing assembly, the flame producing assembly comprising a pocket lighter and sub-unit assembly, the sub-unit assembly being snap-fitted to the pocket lighter. A snap-fit assembly of the utility lighter has the advantage to be easily implemented and faster than the assemblies already known.

Furthermore, the sub-unit assembly comprises an extended wand and a rigid support, and the extended wand and the rigid support are snap-fitted together.

BRIEF DESCRIPTION OF THE DRAWINGS

Other characteristics and advantages of the disclosure will readily appear from the following description of one embodiment, provided as non-limitative examples, in reference to the accompanying drawings.

DETAILED DESCRIPTION

Figure 1:
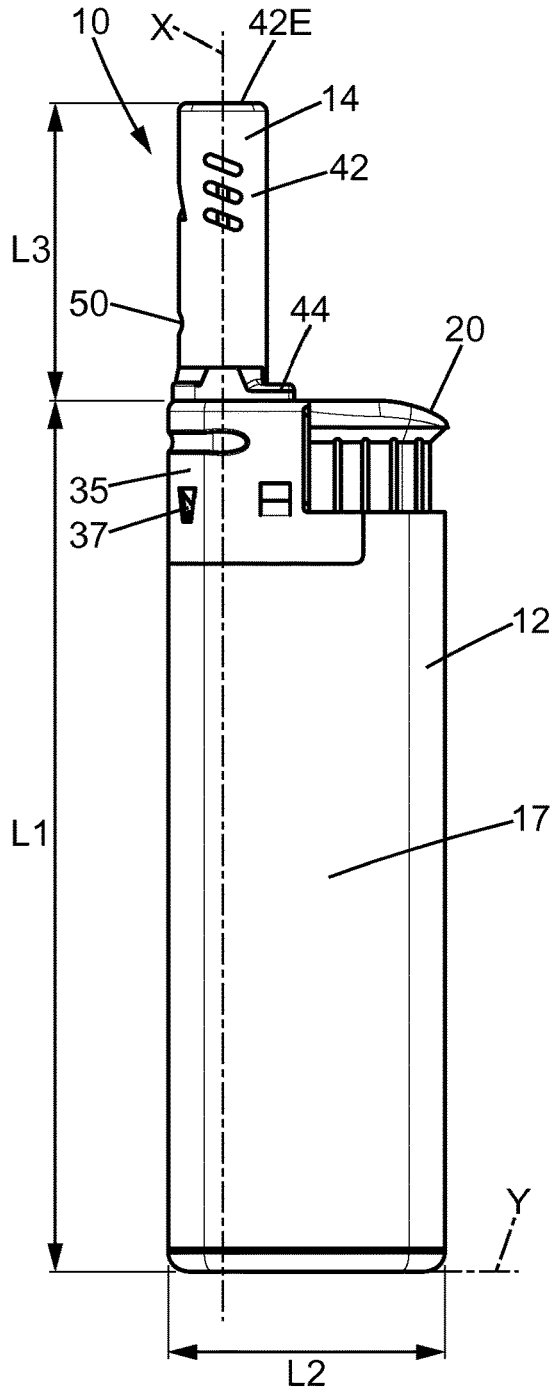
FIG. 1 is a lateral view of a utility lighter, comprising a sub-unit assembly and a pocket lighter, according to a first embodiment.
Figure 2:
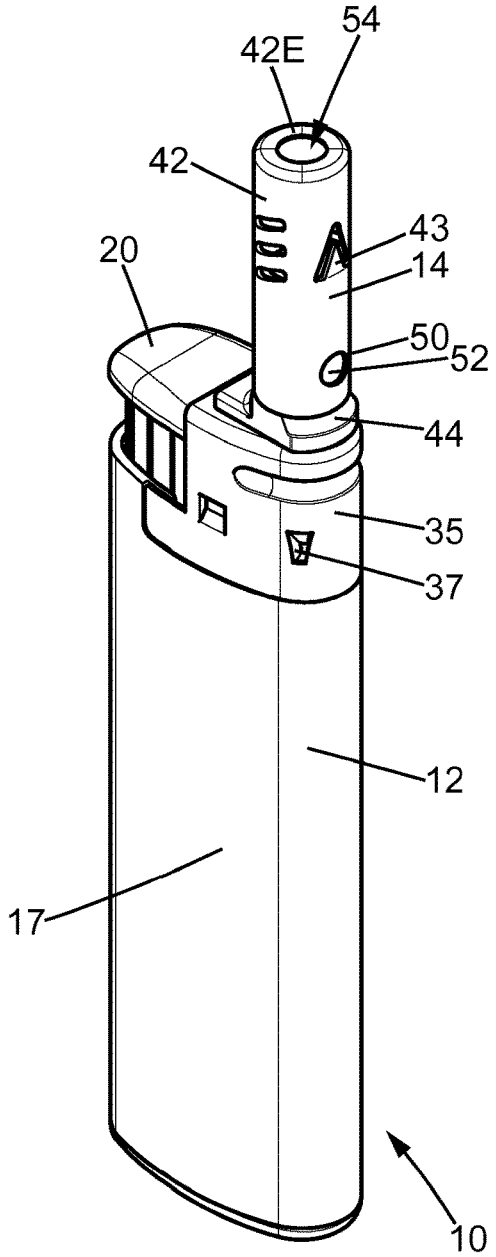
FIG. 2 is a perspective view of the utility lighter of FIG. 1.

FIGS. 1 and 2 illustrate a utility lighter 10 according to the present disclosure. The utility lighter 10 comprises a pocket lighter 12 and a sub-unit assembly 14. The pocket lighter 12 comprises a body 17, a pusher 20 and a cover 35. The pocket lighter 12 extends along a longitudinal axis X. The length L1 of the pocket lighter 12 along the longitudinal axis X is comprised between 5 cm and 12 cm. More precisely, the length L1 of the pocket lighter 12 is approximately 8 cm. The width L2 of the pocket lighter 12 is measurable along a transversal axis Y, which is perpendicular to the longitudinal axis X. The width L2 can be comprised between 1.5 cm and 3 cm. For example, the width L2 can be approximately 2.5 cm.

Figure 3:
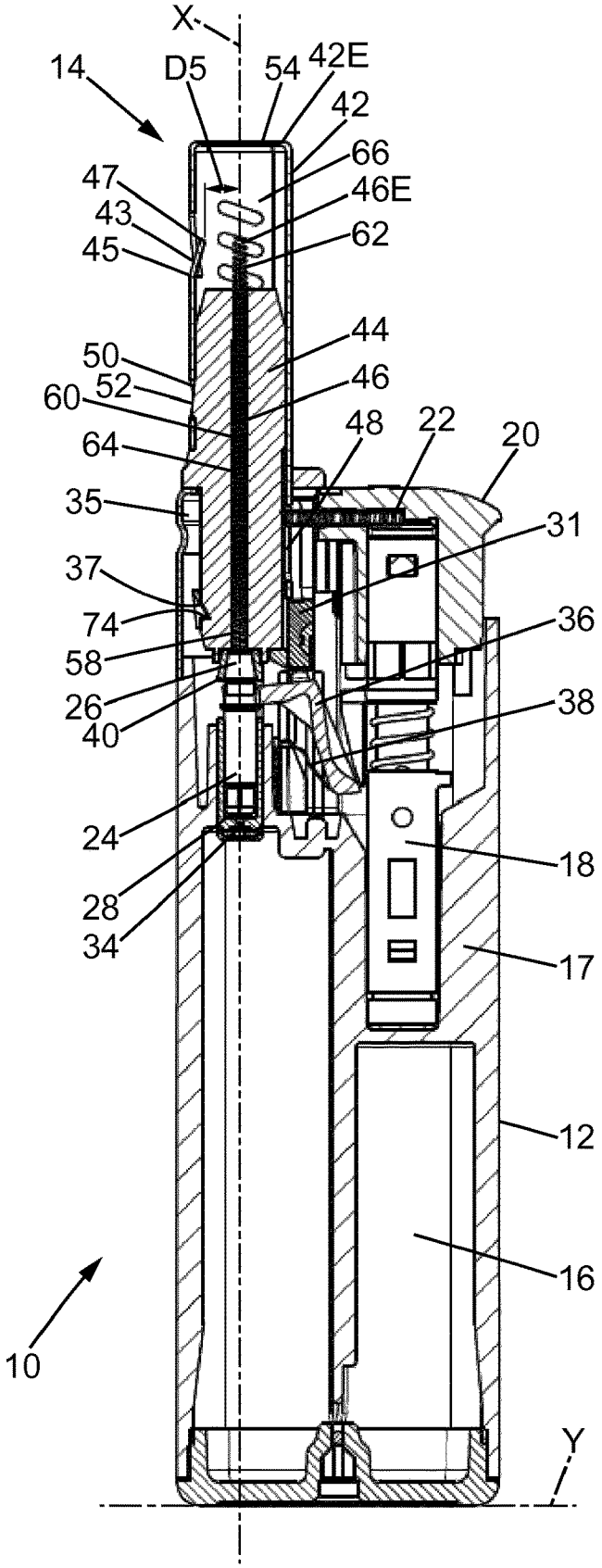
FIG. 3 is a cross-sectional view of the utility lighter according to the first embodiment wherein the utility lighter is not actuated.
Figure 4:
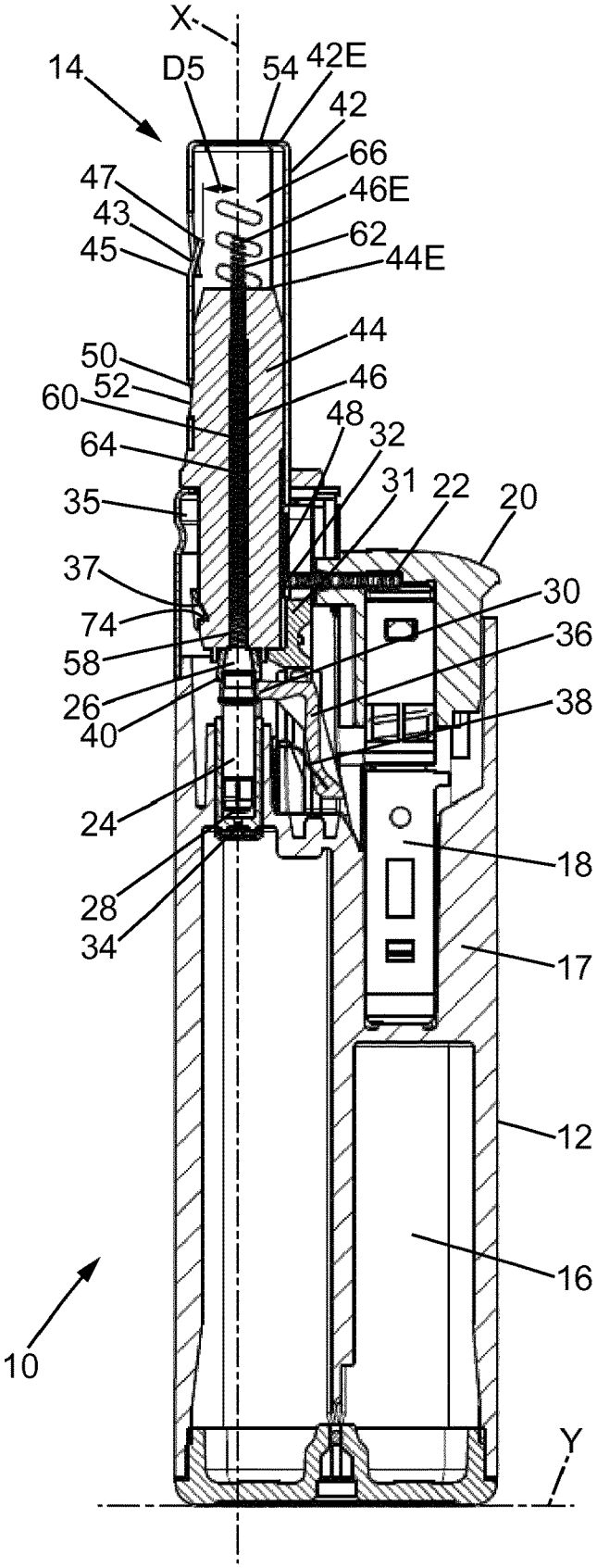
FIG. 4 is a cross-sectional view of the utility lighter according to the first embodiment wherein the utility lighter is actuated.

As depicted in FIGS. 3 and 4, the pocket lighter 12 further comprises a piezoelectric ignition device 18. The pocket lighter 12 is also provided with a pusher 20. The piezoelectric ignition device 18 is connected to the pusher 20. The connection between the pusher 20 and the piezoelectric ignition device 18 is such that the pusher 20 and a portion of the piezoelectric ignition device 18 which is the closest to the pusher 20 are firmly attached together. Consequently, when a user pushes the pusher 20 inward the pocket lighter 12, the piezoelectric ignition device 18 is compressed to produce an elevated potential difference between its two poles 18– and 18+. A first pole 30 is connected to a jet 24 and a second pole 32 is connected to an electrode spring 22. The electrode spring 22 is connected at a first end to the pusher 20. The second end of the electrode spring 22 is connected to the sub-unit assembly 14. The jet 24 comprises an upper end 26 and a lower end 28, regarding the longitudinal axis X. In addition, the jet 24 is movable along the longitudinal axis X. The piezoelectric ignition device 18 provides a potential difference between the first pole 30, located at the level of the upper end 26 of the jet 24 and the second pole 32, located at the second end of the electrode spring 22, which is in contact with the sub-unit assembly 14. The first pole 30 and the second pole 32 are electrically insulated from one another by an insulated member 31. The pocket lighter 12 also comprises a reservoir 16 of gaseous fuel. A valve 34 is located between the reservoir 16 and the jet 24. The reservoir 16 is in fluid communication with the valve 34. The jet 24 is movable along the longitudinal axis X inside the valve 34 between an open position and a closed position to selectively release gaseous fuel. Besides, the pocket lighter 12 comprises a biased pivotal arm 36. The biased pivotal arm 36 is located between the piezoelectric ignition device 18 and the jet 24. In addition, the biased pivotal arm 36 is made of an electrically conductive material. Thus, the biased pivotal arm 36 conducts the electrical potential from the piezoelectric ignition device 18 to the first pole 30. For example, the material of the biased pivotal arm 36 is made of an electrically conductive material. For example, the biased pivotal arm is made of metal or carbon filled resin. As the pusher 20 compresses the piezoelectric ignition device 18, the pusher 20 also acts on the biased pivotal arm 36 which is operatively connected to the jet 24 in order to open the outlet of the valve 34 to selectively release gaseous fuel. An arm spring 38 is placed underneath the biased pivotal arm 36. The arm spring 38 allows maintaining the jet 24 in the closed position. Moreover, the pocket lighter 12 comprises a cover 35. The cover 35 is usually provided for limiting the access of the ignition of the pocket lighter. In the present embodiment, the cover 35 comprises several abutments 37. The abutments 37 cooperates with parts of the sub-unit assembly 14 in order to snap-fit the sub-unit assembly 14 and the pocket lighter 12 together. In addition, a cylindrical seal 40 is placed above the jet 24. The cylindrical seal 40 provides the gaseous seal between the upper end 26 of the jet 24 when lifted by the pivotal arm 36 and the lower portion of the sub-unit assembly 14, the top of the jet 24 being in electrical contact with the lower end 56 of the helical spring 46.

Figure 5:
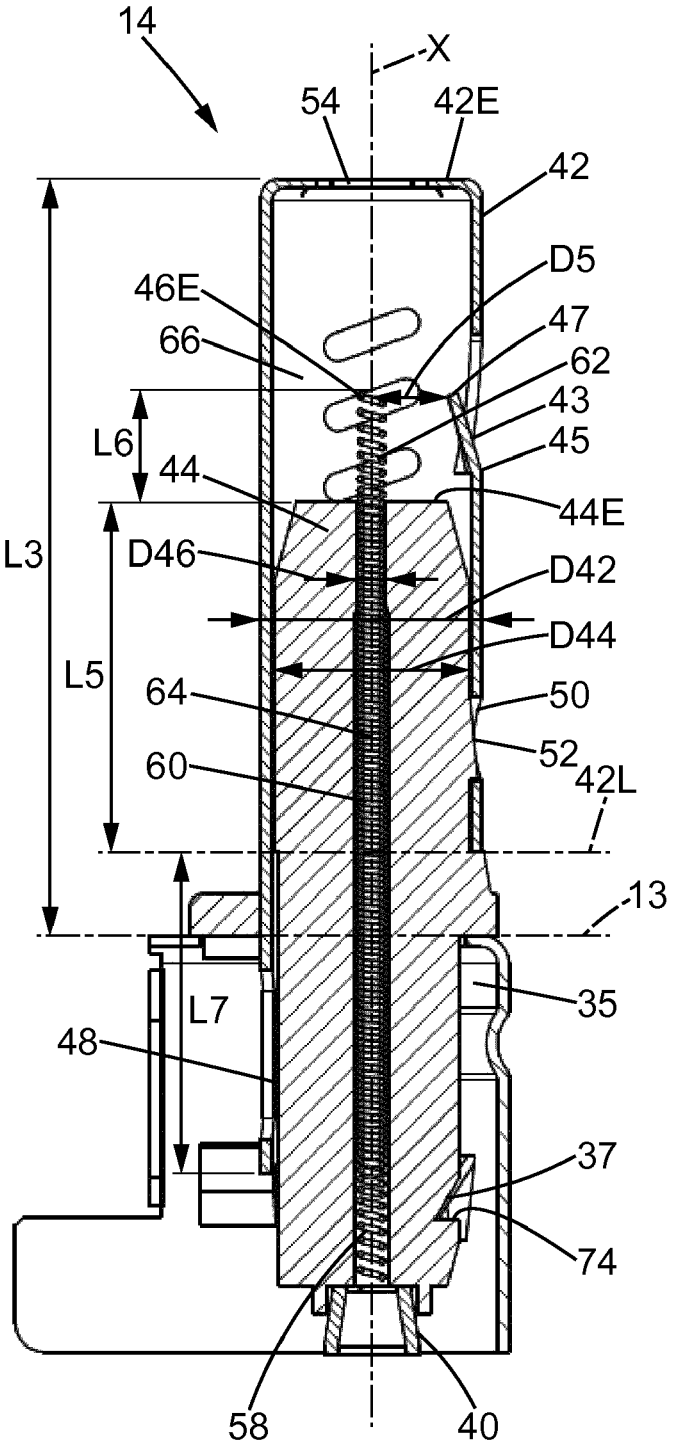
FIG. 5 is a cross-sectional view of the sub-unit assembly according to the first embodiment.
Figure 7:
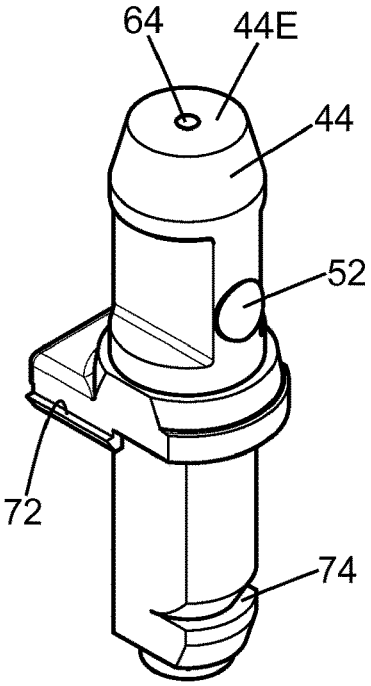
FIG. 7 is a perspective view of the rigid support according to the first embodiment.

As depicted in FIG. 5, the sub-unit assembly 14 comprises a rigid support 44, a helical spring 46 and an extended wand 42. The extended wand 42 extends along the longitudinal axis X. The length L3 of the sub-unit assembly 14 along the longitudinal axis X and extending outside the pocket lighter 12 is comprised between 1.0 cm and 5 cm. More precisely, the length L3 of the sub-unit assembly 14 is approximately 2.7 cm. When the sub-unit assembly 14 is mounted on the pocket lighter 12, the extended wand has a free end 42E. The free end 42E extends away from the pocket lighter 12. FIG. 7 shows the rigid support 44 without the other elements of the sub-unit assembly 14. The rigid support 44 comprises a plastic material, and thus does not have electrically conductive properties.

As it can be seen in FIGS. 3, 4 and 5, the rigid support 44 is mounted inside the extended wand 42. When the sub-unit assembly 14 is mounted on the pocket lighter 12, the rigid support 44 has a free end 44E, extending away from the pocket lighter 12. The free end 44E of the rigid support 44 is located on the same side of the free end 42E of the extended wand 42 along the longitudinal axis X. An inner space 66 is kept free between the free end 44E of the rigid support 44 and the free end 42E of the extended wand 42. As depicted in FIG. 5, the inner space 66 is located inside the extended wand 42, but outside the rigid support 44.

A protrusion 52 is provided on the external surface of the rigid support 44. This protrusion 52 cooperates with a recess 50 of the extended wand 42. The cooperation of these two elements holds the rigid support 44 in position inside the extended wand 42. The rigid support 44 is further provided with a first notch 72 and a second notch 74. The first notch 72 and the second notch 74 allow to assemble the sub-unit assembly 14 to the pocket lighter 12. Thus, the connection of the sub-unit assembly 14 to the pocket lighter 12 is possible by corresponding abutment 37. The first notch 72, the second notch 74 and the abutments 37 are snap-fitted together. When snap-fitted, this connection is not removable. The rigid support 44 comprises also a longitudinal inner opening 64. The longitudinal inner opening 64 extends along the longitudinal axis X and allows the helical spring 46 to pass inside. Thus, the helical spring 46 traverses from side to side the rigid support 44 through the longitudinal inner opening 64. The helical spring 46 is guided and maintained inside the extended wand 42 by the rigid support 44.

Figure 8:
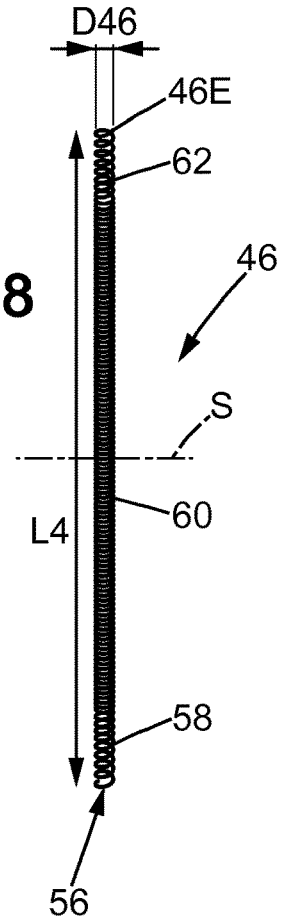
FIG. 8 is a lateral view of the helical spring according.
Figure 9:
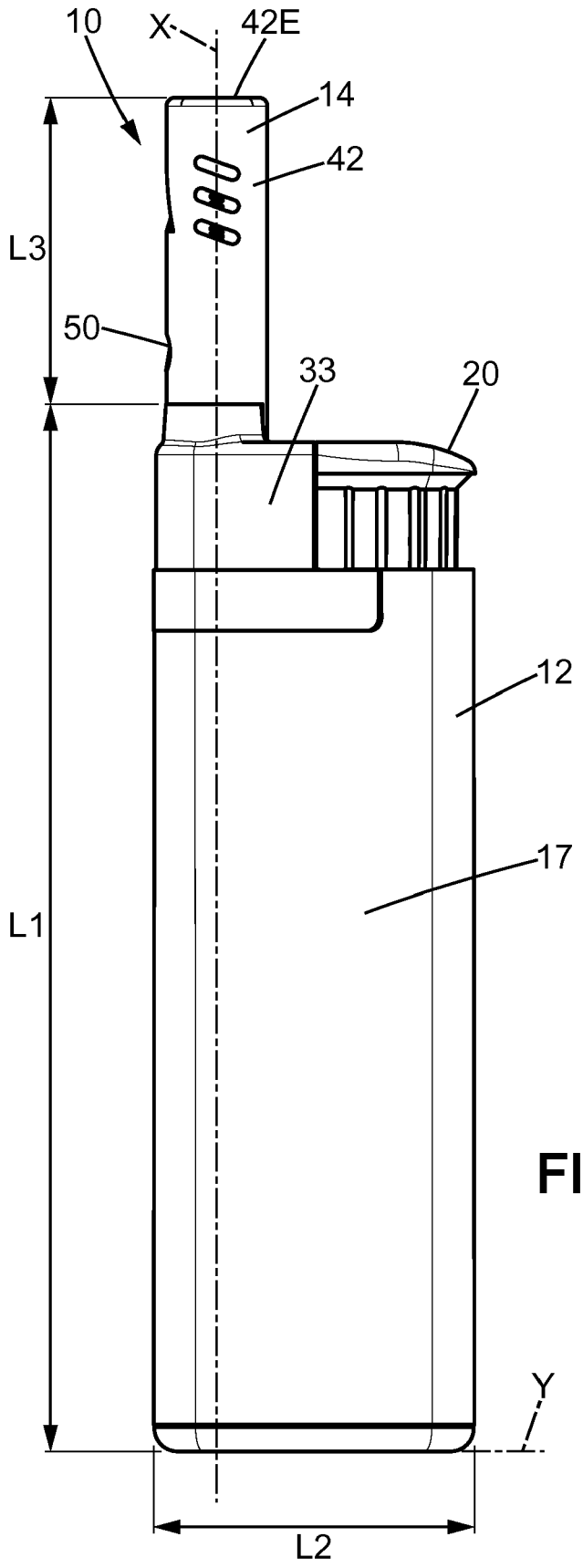
FIG. 9 is a lateral view of a utility lighter, including a sub-unit assembly and a pocket lighter, according to a second embodiment.
Figure 10:
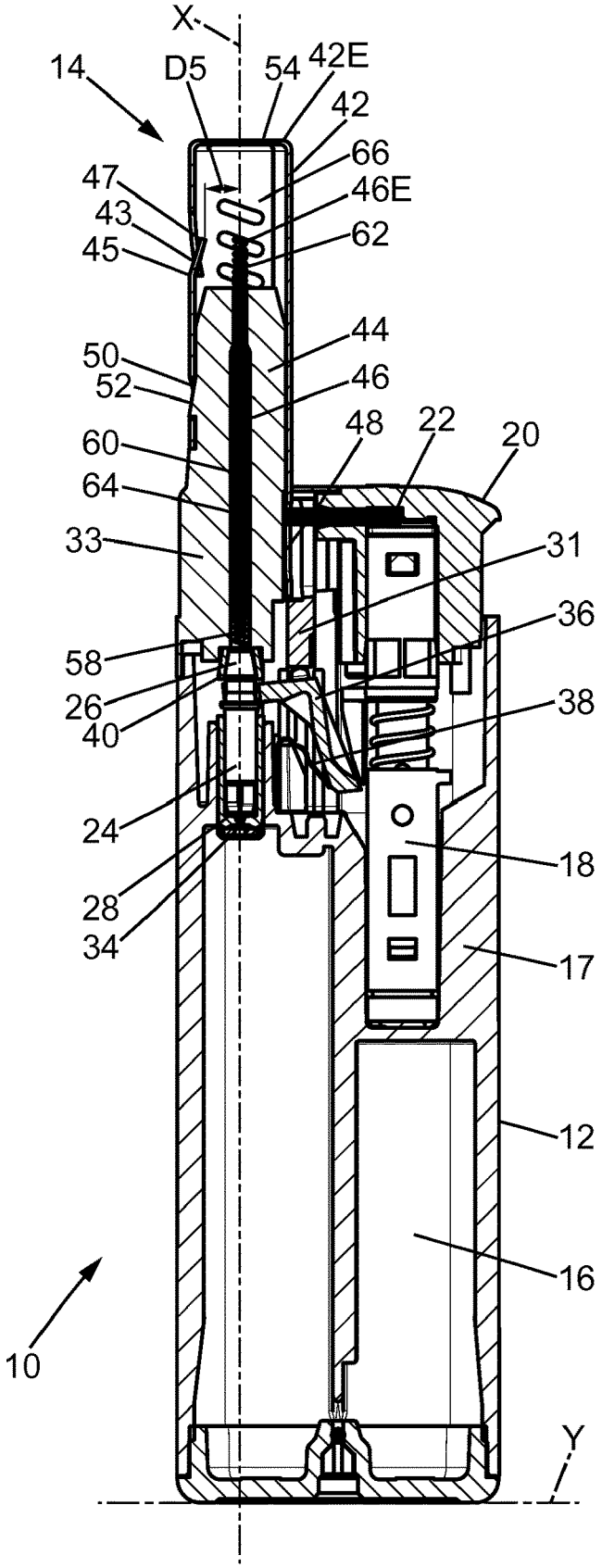
FIG. 10 is a cross-sectional view of the utility lighter according to the second embodiment wherein the utility lighter is not actuated.
Figure 11:
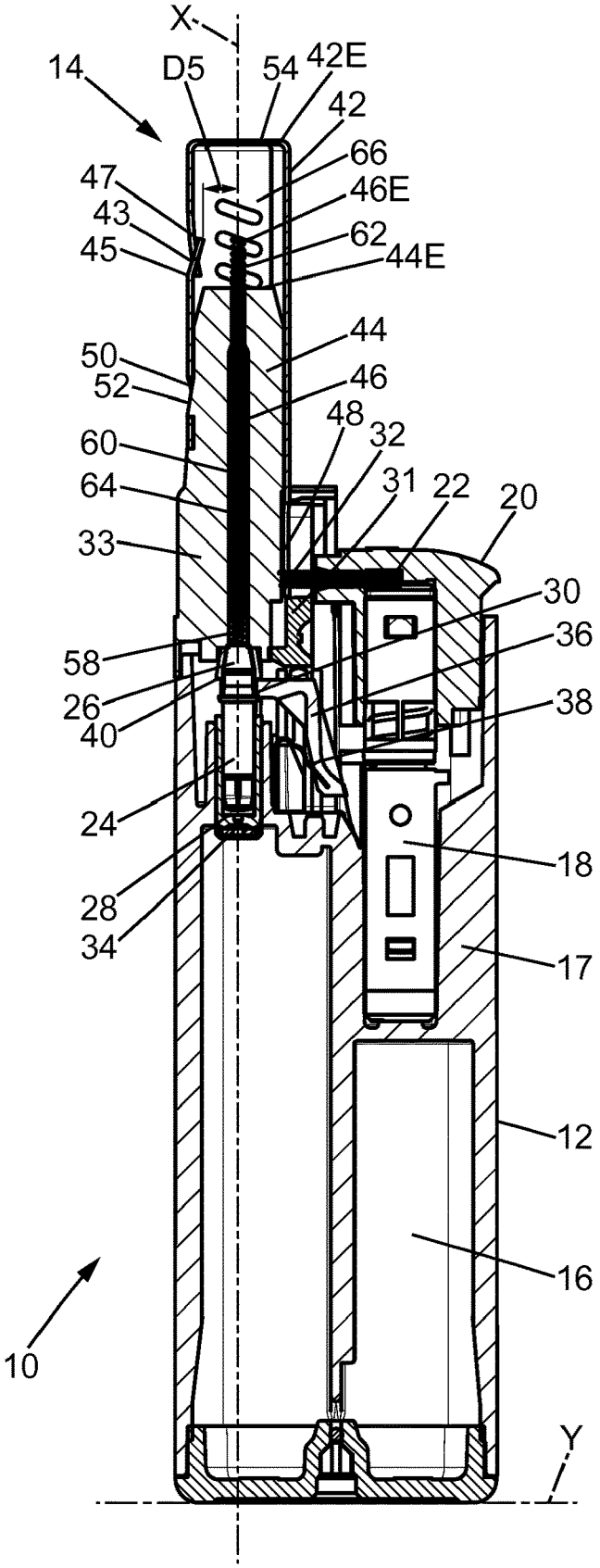
FIG. 11 is a cross-sectional view of the utility lighter according to the first embodiment wherein the utility lighter is actuated.

A shown in FIG. 8, the helical spring 46 has a length L4, taken along the longitudinal axis X, comprised between 5 mm and 120 mm. More preferably, the length L4 of the helical spring 46 is of 32 mm. The outer diameter D46 of the helical spring 46 is comprised between 0.5 mm and 2 mm. For example, the outer diameter D46 is of 1 mm.

Actually, as shown in FIG. 5, when the sub-unit assembly 14 is assembled on the pocket lighter 12, the rigid support 44 protrudes outside the pocket lighter 12 and along the longitudinal axis X at a length L5. The length L5 is thus measured between the free end 44E of the rigid support 44 and a contact line 13 between the sub-unit assembly 14 and the cover 35. The length L5 can be comprised between 5 mm and 40 mm. For instance, the length L5 is of 12.5 mm. In addition, still when the sub-unit assembly 14 is assembled on the pocket lighter 12, the helical spring 46 protrudes to a length L6 outside the pocket lighter 12 and along the longitudinal axis X. The length L6 is thus measured between a free end 46E of the helical spring 46 and the free end 44E of the rigid support 44. The length L6 can be comprised between 2 mm and 10 mm. For instance, the length L6 is of 4 mm. Therefore, we can understand that the free end 46E of the helical spring 46 is located inside the extended wand 42, but outside the free end 44E of the rigid support 44.

Besides, when assembled together, the helical spring 46, the rigid support 44 and the extended wand 42 extend concentrically around the longitudinal axis X, outside the pocket lighter 12. The arrangement being such that the helical spring 46 is the closest element from the longitudinal axis X, the extended wand 42 being the furthest element from the longitudinal axis X, and the rigid support 44 being located concentrically between the extended wand 42 and the helical spring 46. Therefore, as depicted in FIG. 5, the outer diameter D46 of the helical spring 46 is smaller than the outer diameter D42 of the extended wand 42, and the outer diameter D44 of the rigid support 44 is comprised between the outer diameter D42 of the extended wand 42 and the outer diameter D46 of the helical spring 46. For example:

- the outer diameter D42 of the extended wand 42 can have a dimension comprised between 5 mm and 11 mm,
- the outer diameter D44 of the rigid support 44 can have a dimension comprised between 4 mm and 10 mm,
- the outer diameter D46 of the helical spring 46 can have a dimension comprised between 0.5 mm and 2 mm.

Coming back to FIG. 8, the helical spring 46 comprises three portions along its length: a first end portion 58, a middle portion 60 and a second end portion 62. The first end portion 58 is provided to cooperate with the jet 24. The middle portion 60 is provided to be received in the longitudinal inner opening 64 of the rigid support 44. The top portion 62 is provided to protrude in the inner space 66 of the length L6 when the long helical spring 46 is assembled in the sub-unit assembly 14. In such a configuration, the helical spring 46 has a free end 46E which corresponds to the end of the top portion 62. Thus, as shown for example in FIG. 5, the free end 46E of the helical spring 46 is located on the same side of the free ends 42E and 44E of the extended wand 42 and the rigid support 44. In addition, the free end 46E of the helical spring 46 is located inside the extended wand 42, but outside the free end 44E of the rigid support 44.

The pitch of the three portions 58, 60, 62 of the helical spring 46 is comprised between 0.1 mm and 0.6 mm. The pitch of the middle portion 60 can be comprised between 0.1 mm and 0.2 mm. For example, the pitch of the middle portion 60 is 0.1 mm. The pitch of the first end portion 58 is comprised between 0.2 mm and 0.6 mm. The pitch of the second end portion 62 is comprised between 0.2 mm and 0.6 mm. Regarding the entire helical spring 46, the pitch of the middle portion 60 is always smaller than the pitch of the first end portion 58 and the pitch of the second end portion 62. Actually, the coils of the middle portion 60 are dead coils. In other words, the coils of the middle portion 60 are closer in sequence whereas coils of the first end portion 58 and the second end portion 62 are not. Such dimensioning has the following interesting features. In the area of the first end portion 58, the pitch is dimensioned such that the first end portion 58 easily contacts the upper end 26 of the jet 24. Indeed, the coils of the first end portion 58 are not close in sequence. The helical spring 46 can therefore be compressed in the first end portion 58. Thus, the helical spring 46 contacts the upper end 26 of the jet 24 in being in compression, which guarantees a suitable contact between these two members. In the area of the second end portion 62, the pitch is dimensioned in order to suitably diffuse the gas in the air and thus in order to create an easily flammable mixture of air and gas in the inner space 66. In other words, the second end portion 62 of the helical spring 46 is the gas diffuser of the utility lighter. Consequently, the helical spring 46 fulfills the function of diffuser for the utility lighter 10. In the area of the middle portion 60, the coils of the helical spring 46 delimit an inner duct 56. The inner duct 56 extends concentrically along the longitudinal axis X. The pitch of the helical spring 46 in the area of the middle portion 60 is so small that the gas cannot easily go through the coils. The gas is thus confined inside the helical spring 46 and thus inside the inner duct 56. Therefore, the helical spring 46 fulfills a function of gas duct for the utility lighter 10. In addition, the coils being closer in sequence in the middle portion 60, they create a rigid portion which facilitates the insertion of the helical spring 46 in the rigid support 44 during the assembly.

Actually, according to one embodiment, the pitches of the first end portion 58 and the second end portion 62 are identical. Therefore, the helical spring is symmetrical with respect to a perpendicular axis S through its middle along its length L4. The pitch of the first end portion 58 is similar to the pitch of the second end portion 62 in order to insert the helical spring 46 in any longitudinal direction inside the longitudinal inner opening 64 during the assembly of the sub-unit assembly 14. Any free end of the helical spring 46 can thus be inserted at first inside the longitudinal inner opening 64. Consequently, this feature facilitates the assembly of the sub-unit assembly 14 by avoiding a step of differentiation between the first end portion 58 and the second end portion 62. According to another embodiment, the pitches of the first end portion 58 and the second end portion 62 are not identical. However, in such a configuration, the pitch of the middle portion 60 is still smaller than the pitch of the first end portion 58 and the pitch of the second end portion 62.

Figure 6:
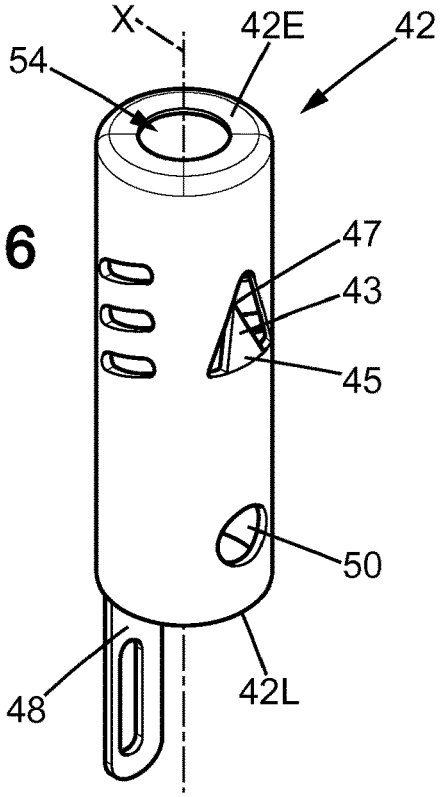
FIG. 6 is a perspective view of the extended wand.

As better shown in FIG. 6, the sub-unit assembly comprises the extended wand 42. The extended wand 42 has a general cylinder shape, which extends along the longitudinal axis X. The extended wand 42 comprises an aperture 54 at its upper end. The upper end of the extended wand 42 corresponds to its free end 42E when the sub-unit assembly 14 is assembled with the pocket lighter 12 to form the utility lighter 10, as illustrated in FIGS. 3 and 4. The flame escapes from this aperture 54. The extended wand 42 further comprises at its lower end 42L, opposite to the free end 42E, an extension 48. This extension 48 has a general shape of a tongue and has a free end 48E. The length L7 of the extension 48 along the longitudinal axis X is measured between the lower end 42L of the extended wand 42 and the free end 48E of the extension 48. The length L7 of the extension 48 can be comprised between 5 mm and 15 mm. For instance, the length L7 is of 11.5 mm. During the actuating downwards of the pusher 20, the extension 48 allows for contact of the extended wand 42 with the electrode spring 22. The electrical potential created at the second pole 32 is therefore transmitted to the extended wand 42 through the extension 48. In other words, the electrode spring 22 is connected to the sub-unit assembly 14 by means of the extension 48. The extended wand 42 also comprises an antenna 43. The antenna 43 protrudes forwards the inner space 66. The antenna 43 has a general triangular shape when viewed from the face. The antenna 43 comprises a base 45 and a tip 47. The distance D5 between the tip 47 and the free end of the helical spring 46 is favorable for the apparition of the electrical arc, which results of the potential difference created by the piezoelectric ignition device 18. For example, as illustrated in FIG. 5, the distance D5 between the tip 47 and the free end of the helical spring 46 is comprised between 2.5 mm and 3 mm. The electrical arc is thus created in an interelectrode space which is located in the inner space 66. When the arc electric created between the tip end 47 of the antenna 43 and the free end of the helical spring 46 (i.e. the end of the top portion 62) meets the mixture of gas and air, a flame is so created. As a result, the flame escape from the utility lighter 10 through the aperture 54, located at the free end 42E of the extended wand 42.

The sub-unit assembly 14 thus assembled is rigid. Especially, the sub-unit assembly 14 is rigid enough to not bent and to keep a straight and elongated shape during the assembly between the sub-unit assembly 14 and the pocket lighter 12. The feature is made possible partly thanks to the rigid support 44 and the extended wand 42.

When the sub-unit assembly 14 and the pocket lighter are connected together, the ignition of a flame is as follow. A user pushes downwards the pusher 20. The piezoelectric ignition device 18 is thus actuated and creates a first electric potential on the electrode spring 22 and a second electric potential on the biased pivotal arm 36. The extension 48 contacting the electrode spring 22, the first electric potential is then transmitted to the extension 48. Because of the electrically conductive properties of the extended wand 42, the first electric potential is conducted along the extended wand, and especially until the tip 47 of the antenna 43. When the pusher 20 is pushed downwards, the biased pivotal arm 36 contacts the piezoelectric ignition device 18. The second electric potential is thus transmitted to the biased pivotal arm 36. Then, the second electric potential is transmitted to the jet 24. The second electric potential is therefore transmitted to the helical spring 46 through the upper end 26 of the jet 24. The helical spring 46 fulfills therefore a function of electrical conductor. The first electric potential and the second electric potential create therefore a potential difference which is favorable to the creation of an electrical arc in the interelectrode space. However, despite the electrical properties of the extended wand 42, there is no risk of electric shock for a user, since the first pole 30 is surrounded by the body 17 of the pocket lighter 12. The body 17 being made of a non-electrically conductive material, the user cannot therefore touch the first pole 30. In the meantime, when the pusher 20 is pushed downwards, it actuates the biased pivotal arm 36 which raises the jet 24. The jet 24 releases the valve 34. As a result, the gas is released from the reservoir 16 and through the jet 24 and the helical spring 46 until the second end portion 62 of the helical spring 46. The mixture of gas and air thus created in the inner space 66 then catches fire should it meets the electrical arc.

Figure 12:
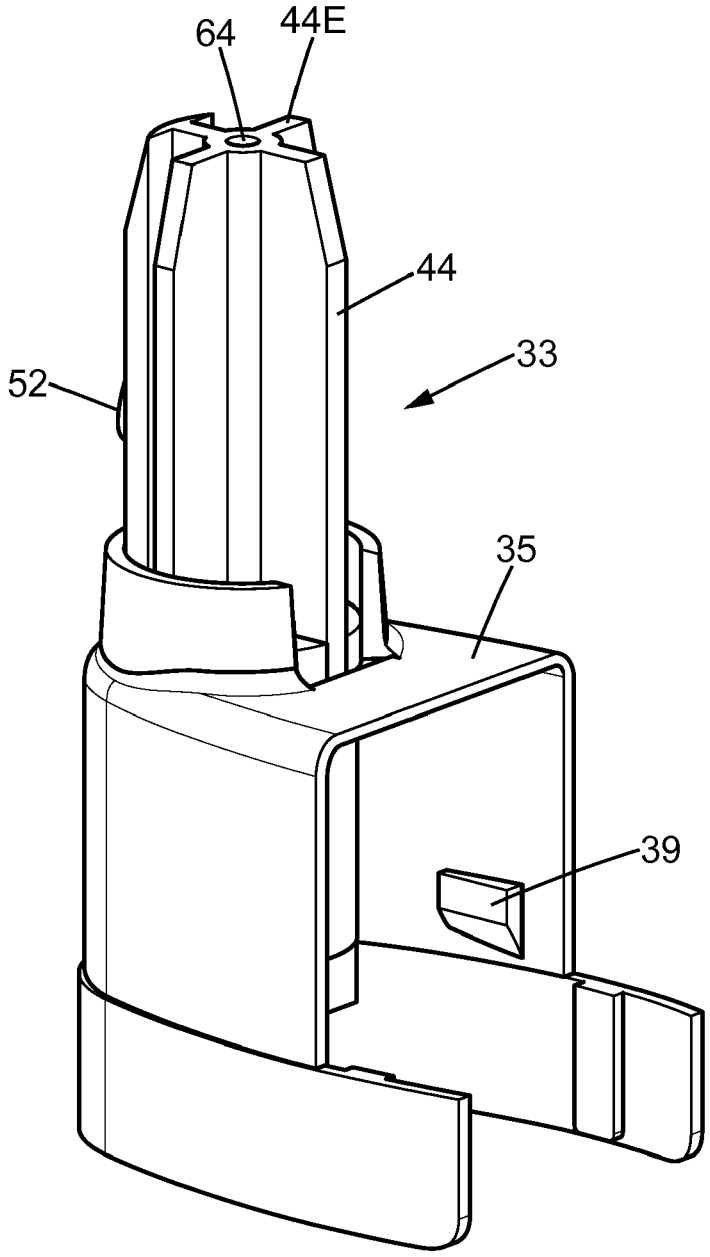
FIG. 12 is a perspective view of the rigid support according to the second embodiment.

FIGS. 9, 10, 11 and 12 illustrate a second embodiment of a utility lighter 10 according to the present disclosure. In this second embodiment, the rigid support 44 and the cover 35 are formed in a sole molded piece 33. This molded piece 33, shown in FIG. 12, is molded in an electrically insulating thermoplastic resin. The sub-unit assembly 14, according to this second embodiment, thus comprises also the cover 35. Such a molded piece 33 has the advantage of reducing the number of pieces required, since the cover 35 and the rigid support 44 are the same piece. In addition, there is no more need for abutments 37 and second notch 74, since the rigid support 44 and the cover 35 are already assembled together. Furthermore, such an embodiment improves the insulation of the electrical circuit by avoiding short-circuit through the cover 35. Indeed, the cover 35, usually metallic, could create a failure in the ignition. When the cover is made of an electrically insulating thermoplastic resin, there is no more risk of any short-circuit. Besides, this feature protects the user of a possible electrical discharge in his fingers.

The molded piece 33 comprises two protrusions 39, which allows it to be snap-fitted to the body 17 of the pocket lighter 12. When snap-fitted, this connection between the molded piece 33 and the body 17 is not removable. FIG. 12 illustrates only one protrusion 39, the other protrusion 39 being hidden by the cover.

This second embodiment provides another advantage that consists on a greater precision of positioning of this molded piece 33 with respect to the pocket lighter 12 and therefore to the jet 24. Thus, the achievement of a good sealing between the upper part 26 of the jet 24 and the cylindrical seal 40 is facilitated.

The disclosure further concerns a method for manufacturing a flame producing assembly. The method consists first to provide the sub-unit assembly 14. To this aim, the helical spring 46 is inserted inside the rigid support 42. Then, this set is snap-fitted inside the extended wand 42, forming therefore the sub-unit assembly 14. After that, the sub-unit assembly 14 according to the first embodiment, is snap-fitted on the cover 35 of the pocket lighter 12, the cover 35 being previously attached to the body 17 of the pocket lighter 12. According to the second embodiment, the sub-unit assembly is snap-fitted directly on the body 17 of the pocket lighter 12. In this way, according to either the first or the second embodiment, the sub-unit assembly 14 is fixedly attached to the pocket lighter 12. Such an assembly has the advantage to be easily implemented. In addition, the assembly of the utility lighter 10 according to the second embodiment has the advantage to be easier assembled than the utility lighter 10 according to the first embodiment, the preliminary fixing step of the cover 35 on the body 17 not being required. An assembly on an automatic machine for producing several flames producing assembly is therefore achievable.

The invention claimed is:

1. A flame producing assembly comprising:
a pocket lighter extending along a longitudinal axis and defining a length; and
a rigid sub-unit assembly extending along the longitudinal axis of the pocket lighter;
wherein:
the sub-unit assembly includes:
an extended wand snap-fitted to and extending from the pocket lighter to an extended wand free end; and
a plastic rigid support disposed inside the extended wand and having a longitudinal inner opening extending therethrough;
the pocket lighter includes:
a lighter body having a top end and a bottom end;
a piezoelectric ignition assembly positioned within the lighter body and suitable for producing an electric charge; and
a lighter cover extending over the top end of the pocket lighter body to limit access to the ignition assembly;
wherein the extended wand is electrically coupled to the ignition assembly; and
the sub-unit assembly is separately formed from and attached to the lighter cover.

2. The flame producing assembly according to claim 1, wherein:
the pocket lighter defines a fuel reservoir therein; and
the longitudinal inner opening extending through the rigid support is in fluid communication with the fuel reservoir.

3. The flame producing assembly according to claim 1, wherein the extended wand has electrically conductive properties facilitating the conveyance of an electric charge produced by the ignition assembly thereto.

4. The flame producing assembly according to claim 1, wherein:
the rigid support includes a protrusion and the extended wand includes a recess; and
the recess in the extended wand is adapted to cooperate with the protrusion on the rigid support to hold the rigid support in position inside the extended wand.

5. The flame producing assembly according to claim 1, wherein the sub-unit assembly is snap-fitted onto the pocket lighter.

6. The flame producing assembly according to claim 1, wherein the sub-unit assembly and the lighter cover are configured to be snap-fitted together.

7. The flame producing assembly according to claim 1, wherein the rigid support is directly connected to the lighter cover.

8. The flame producing assembly according to claim 7, wherein the rigid support and the lighter cover are configured to be snap-fitted together.

9. The flame producing assembly according to claim 1, wherein the rigid support has a connecting end within the lighter body, a free end within the extended wand and extending beyond the lighter cover, and a flange between the connecting end and the free end and extending over and engaging the lighter cover.

10. The flame producing assembly according to claim 9, wherein the flange of the rigid support is snap-fitted to the lighter cover.

11. The flame producing assembly according to claim 1, further comprising a pusher connected with the ignition assembly to actuate the ignition assembly.

12. A method for manufacturing a flame producing assembly, the method comprising snap-fitting a rigid sub-unit assembly to a pocket lighter, the sub-unit assembly extending along the longitudinal axis of the pocket lighter, the sub-unit assembly comprising an extended wand and a plastic rigid support disposed inside the extended wand, the pocket lighter comprising a pocket lighter body and a cover extending over the top of the pocket lighter body to limit access to a piezoelectric ignition assembly within the pocket lighter body, by coupling the sub-unit assembly to the cover of the pocket lighter.

13. The method for manufacturing a flame producing assembly according to claim 12, further comprising snap fitting the sub-unit assembly to the cover of the pocket lighter.

14. The method for manufacturing a flame producing assembly according to claim 13, further comprising snap-fitting the extended wand to the rigid support of the sub-unit assembly and then snap-fitting the sub-unit assembly to the pocket lighter cover.

15. A flame producing assembly comprising:
a lighter body having a top end and a bottom end and defining a fuel reservoir therein;
a piezoelectric ignition assembly within the lighter body, the ignition assembly comprising a cover configured to be extended over the top end of the lighter body to limit access to the ignition assembly therein;
a rigid sub-unit assembly extending along the longitudinal axis of the pocket lighter, the sub-unit assembly comprising
a plastic rigid support extending from the cover in a direction away from the cover and lighter body when the cover is extended over the lighter body; and
an extended wand extending over the rigid support and electrically coupled with the ignition assembly.

16. The flame producing assembly according to claim 15, wherein the ignition assembly is adjacent the top end of the lighter body.

17. The flame producing assembly according to claim 16, further comprising a pusher extending from the top end of the lighter body and connected with the ignition assembly to actuate the ignition assembly.

18. The flame producing assembly according to claim 15, wherein the rigid support and the cover are formed in a sole molded piece.

19. The flame producing assembly according to claim 15, wherein the rigid support comprises a plastic material and the cover is formed of an electrically insulating thermoplastic resin.

20. The flame producing assembly according to claim 15, wherein the rigid support has a protrusion cooperating with a recess on the extended wand to hold the rigid support in position within the extended wand.

* * * * *